US010185243B2

(12) United States Patent
Kondo

(10) Patent No.: US 10,185,243 B2
(45) Date of Patent: Jan. 22, 2019

(54) FIXING DEVICE ADJUSTING OUTPUT CURRENT VALUE OF ELECTRIC CURRENT FLOWED BY ELECTRIC DISCHARGE OF ELECTRIC CHARGE SUPPLYING DEVICE AND IMAGE FORMING APPARATUS INCLUDING THE SAME

(71) Applicant: KYOCERA Document Solutions Inc., Osaka (JP)

(72) Inventor: Akihiro Kondo, Osaka (JP)

(73) Assignee: KYOCERA Doucment Solutions Inc., Osaka (JP)

( * ) Notice: Subject to any disclaimer, the term of this patent is extended or adjusted under 35 U.S.C. 154(b) by 0 days.

(21) Appl. No.: 15/921,814

(22) Filed: Mar. 15, 2018

(65) Prior Publication Data

US 2018/0275558 A1 Sep. 27, 2018

(30) Foreign Application Priority Data

Mar. 23, 2017 (JP) ..... 2017-057298

(51) Int. Cl.
*G03G 15/045* (2006.01)
*G03G 15/00* (2006.01)
*G03G 15/20* (2006.01)

(52) U.S. Cl.
CPC ..... *G03G 15/045* (2013.01); *G03G 15/2028* (2013.01); *G03G 15/2039* (2013.01); *G03G 15/2053* (2013.01); *G03G 15/55* (2013.01)

(58) Field of Classification Search
CPC ..... G03G 15/045
USPC ..... 399/50
See application file for complete search history.

(56) References Cited

FOREIGN PATENT DOCUMENTS

JP 03211578 A * 9/1991
JP 2000-155487 A 6/2000

* cited by examiner

*Primary Examiner* — Quana Grainger
(74) *Attorney, Agent, or Firm* — Studebaker & Brackett PC

(57) ABSTRACT

A fixing device includes a rotatable fixing member, a rotatable pressuring member and an electric charge supplying device. The fixing member contacts a recording medium having a toner image and heats the recording medium. The pressuring member pressures the recording medium between the fixing member and the pressuring member. The electric charge supplying device electrically discharges electric charges with same polarity as toner and supplies the electric charges to the fixing member. An output current value electrically discharged by the electric charge supplying device is adjusted on the basis of a toner charged amount of the toner image. When the toner charged amount is equal to or more than a threshold value, the output current value is set to a normal current value. When the toner charged amount is less than the threshold value, the output current value is set to a current value higher than the normal current value.

18 Claims, 3 Drawing Sheets

FIXING DEVICE ADJUSTING OUTPUT CURRENT VALUE OF ELECTRIC CURRENT FLOWED BY ELECTRIC DISCHARGE OF ELECTRIC CHARGE SUPPLYING DEVICE AND IMAGE FORMING APPARATUS INCLUDING THE SAME

INCORPORATION BY REFERENCE

This application is based on and claims the benefit of priority from Japanese Patent application No. 2017-057298 filed on Mar. 23, 2017, the entire contents of which are incorporated herein by reference.

BACKGROUND

The present disclosure relates to a fixing device heating and fixing a toner image formed on a recording medium and an image forming apparatus including this fixing device.

Conventionally, an image forming apparatus of an electrographic manner includes a fixing device fixing a toner image formed on a recording medium, such as a sheet. The fixing device includes a fixing member and a pressuring member composed of a roller or a belt and a fixing nip is formed between the fixing member and the pressuring member. In the fixing device, the recording medium conveyed from a transferring device is guided to the fixing nip along an entry guide. The fixing device causes the recording medium, on which the toner image is formed, to pass through the fixing nip, thereby heating and pressuring the toner image to fix the toner image to the recording medium.

A top layer of the fixing device is made of fluororesin, such as PFA, so that the toner is hardly adhered. The fluororesin of which the top layer of the fixing device has properties of being electrically charged easily on the most negative side (a minus side) on a triboelectric series. The fixing member may be electrically charged with a negative by friction between the fixing member and the pressuring member or the sheet. In this case, when the toner charged with a positive (plus) is used, electrical attraction force may be generated between the toner and the fixing member, the toner may be adhered to the fixing member, and then, electrostatic offset phenomenon may occurs. In order to restrain the electrostatic offset phenomenon, there is, for example, the fixing device including a charging means (an electric charge supplying device) electrically charging a surface of a rotator (the fixing member) made of a release layer having insulating properties with the same polarity as that of the toner.

A conventional fixing device causes an electric charge supplying device to supply a constant amount of electric charge to the surface of the fixing member in order to restrain the above-mentioned electrostatic offset phenomenon. However, because the charged amount of the toner image formed on the recording medium is not constant, the amount of electric charge of the fixing member is set so as to be increased in accordance with the toner image with a small charged amount. For example, because it takes time for rising of electrical charging in a development part that developing the toner image immediately after the activation of the image forming apparatus, the charged amount of the toner may be reduced. Thus, if the fixing member has a large amount of electric charge, this may cause a problem that a toner resin component of the toner is adhered to the electric charge supplying device and a life of the device is reduced.

Further, in the fixing device, electric charges electrically charged with the fixing member may be spontaneously discharged. The longer the time between fixing processes it takes, the more the amount of discharge increases. Thus, when the fixing process is carried out after a lapse of some time, the electrostatic offset phenomenon may occur due to the insufficient amount of electric charge in the fixing member.

SUMMARY

In accordance with the present disclosure, a fixing device includes a fixing member, a pressuring member and an electric charge supplying device. The fixing member is rotatably provided, comes into contact with a recording medium on which a toner image is formed, and heats the recording medium. The pressuring member is rotatably provided, and pressures the recording medium passing between the fixing member and the pressuring member. The electric charge supplying device electrically discharges electric charges with same polarity as polarity of toner composing the toner image and supplies the electric charges to a surface of the fixing member. An output current value of an electric current flowed by the electric discharge of the electric charge supplying device is adjusted on the basis of a toner charged amount of the toner image. When the toner charged amount is equal to or more than a predetermined charged amount threshold value, the output current value is set to a normal current value. When the toner charged amount is less than the predetermined charged amount threshold value, the output current value is set to a current value higher than the normal current value.

In accordance with the present disclosure, an image forming apparatus includes the fixing device as described above.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
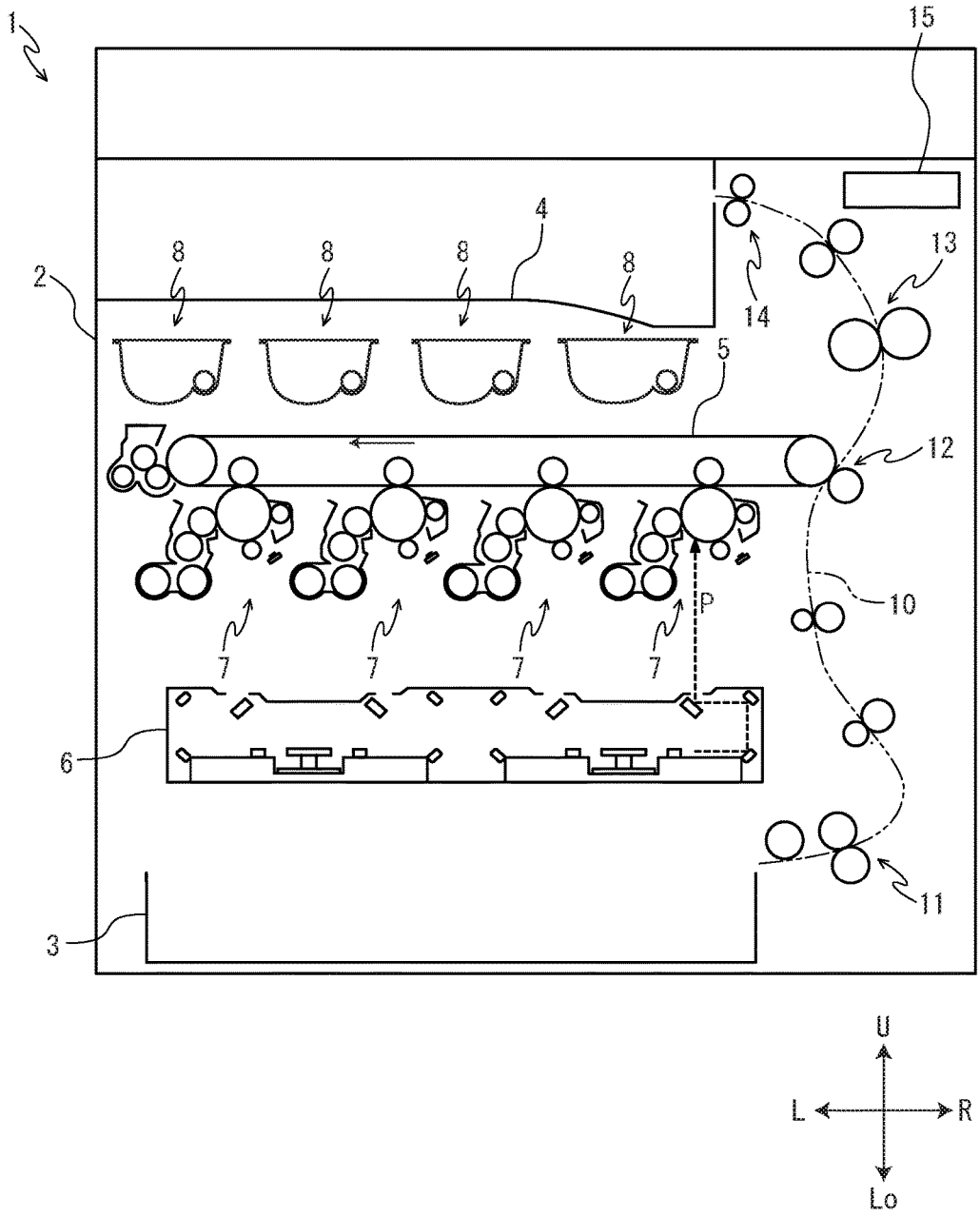
FIG. 1 is a sectional view schematically showing a color printer according to an embodiment of the present disclosure.

First, an entire configuration of a color printer (an image forming apparatus) according to an embodiment of the present disclosure will be described with reference to FIG. 1. Hereinafter, for convenience of description, it will be described so that the front side of the color printer is positioned at the near side on a paper sheet of FIG. 1. Arrows L, R, U and Lo in each of the drawings respectively indicate a left side, a right side, an upper side and a lower side of the color printer 1.

The color printer 1 includes a roughly box-formed printer body 2. In a lower part of the printer body 2, a sheet feeding cartridge 3 storing sheets is provided and, in an upper part of the printer body 2, an ejected sheet tray 4 is provided.

At a central part of the printer body 2, an intermediate transferring belt 5 is windingly stretched among a plurality of rollers. At a lower side of the intermediate transferring belt 5, an exposure device 6 composed of a laser scanning unit (LSU) is provided. Along a lower face side of the intermediate transferring belt 5, four image forming parts 7 are provided for respective toner colors (for example, four colors of yellow, cyan, magenta and black). Each image forming part includes a rotatably photosensitive drum. At the periphery of the photosensitive drum, a charging device, a development device, a primary transferring part, a cleaning device and a static eliminator are disposed in a sequential order of a primary transferring process. At an upper side of development devices of the image forming parts 7, toner containers 8 corresponding to respective image forming parts 7 are provided for the respective toner colors (for example, four colors of yellow, cyan, magenta and black).

At a right side part in the printer body 2, a conveying path 10 of the sheet is provided in upward and downward directions. At an upstream end of the conveying path 10, a sheet feeder 11 is provided. At a middle stream part of the conveying path 10, a secondary transferring part 12 is provided at a right end side of the intermediate transferring belt 5. At a downstream part of the conveying path 10, a fixing device 13 is provided. At a downstream end of the conveying path 10, a sheet ejecting part 14 is provided. Moreover, in the printer body 2, a controlling device 15 controlling fixing process of the fixing device 13 is provided. The controlling device 15 is configured to include a controlling part, such as CPU, and a storing part, such as ROM and RAM. The controlling device 15 may be provided in the fixing device 13 or, as the controlling device 15, a main controlling device (not shown) generally controlling the color printer 1 may be applied.

Next, an image forming operation of the color printer 1 as described above will be described. In the color printer 1, image data is inputted and a printing start is directed from an external computer or the like. In each image forming part 7, the photosensitive drum is electrically charged by the charging device, and then, exposed on the basis of the image data by the exposure device 6, and thereby, an electrostatic latent image is formed on the photosensitive drum. The electrostatic latent image on the photosensitive drum is developed for a toner image of each color by the development device. The toner image on the photosensitive drum is primarily transferred to a surface of the intermediate transferring belt 5 by the primary transferring part. By the four image forming parts 7, the operation described above is repeated, and thereby, a toner image of full color (a color toner image) is formed on the intermediate transferring belt 5. The color toner image is supplied to a secondary transferring part 12 at a predetermined secondary transfer timing by rotation of the intermediate transferring belt 5.

On the other hand, a sheet stored in the sheet feeding cartridge 3 or a manual bypass tray (not shown) is picked up by the sheet feeder 11, and then, conveyed on the conveying path 10. Subsequently, the sheet on the conveying path 10 is conveyed to the secondary transferring part 12 at the predetermined secondary transfer timing described above. In the secondary transferring part 12, the color toner image on the intermediate transferring belt 5 is secondarily transferred to the sheet. The sheet having the secondarily transferred color toner image is conveyed to the fixing device 13 on the conveying path 10 and the color toner image is fixed to the sheet by the fixing device 13. Then, the sheet having the fixed color toner image is ejected from the sheet ejecting part 14 to the ejected sheet tray 4.

Figure 2:
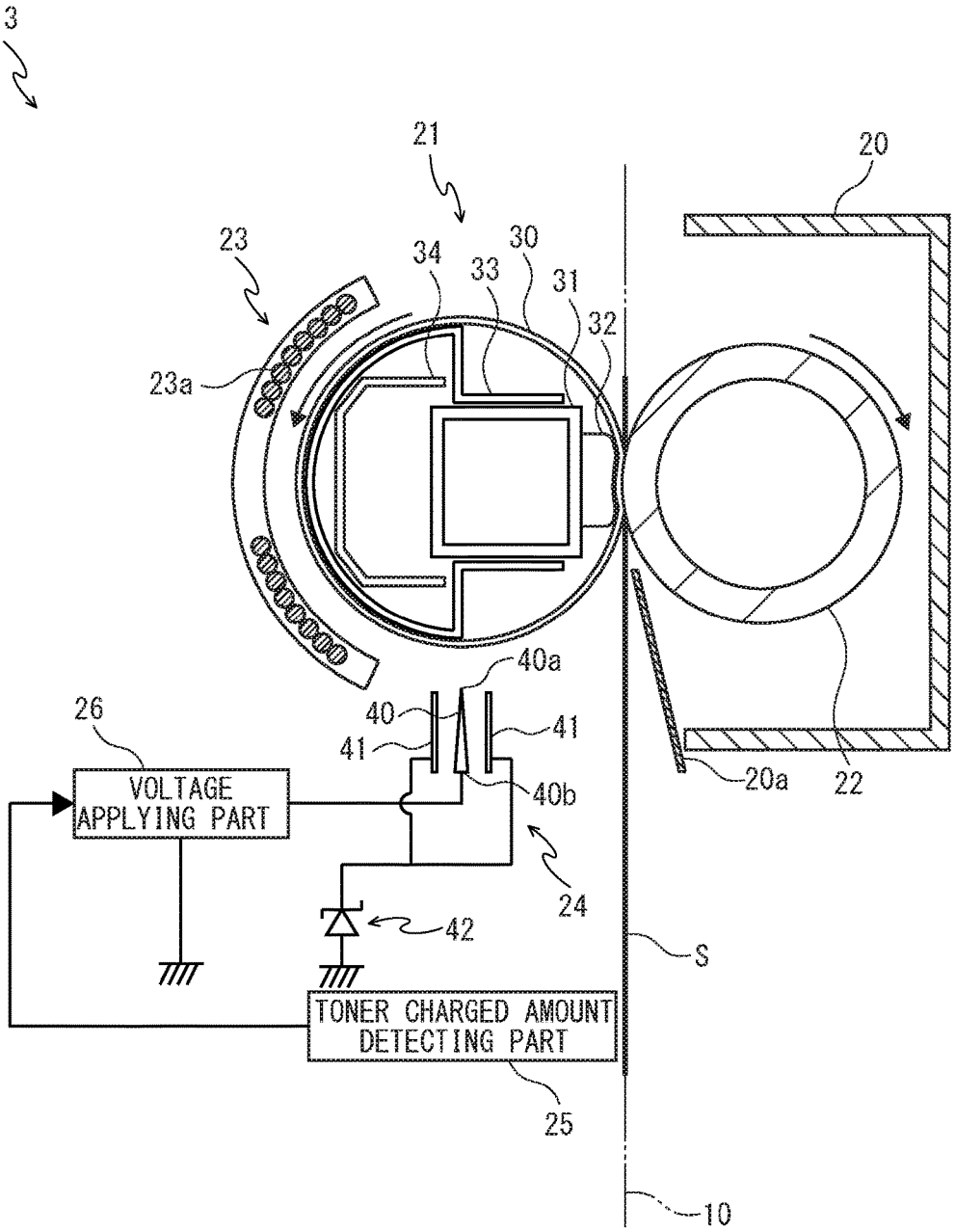
FIG. 2 is a sectional view showing a fixing device according to the embodiment of the present disclosure.

Next, the fixing device 13 of the embodiment will be described with reference to FIG. 2. The fixing device 13 includes a casing 20, a fixing member 21, a pressuring member 22, a heating member 23 (a heat source), an electric charge supplying device 24, a toner charged amount detecting part 25 and a voltage applying part 26. The fixing member 21 and the pressuring member 22 are respectively disposed at boss side (the left side and the right side) across the conveying path 10 and a fixing nip N is formed between the fixing member 21 and the pressuring member 22. The heating member 23 is disposed so as to cover the left side of the fixing member 21. The toner charged amount detecting part 25 and the voltage applying part 26 are operated by being controlled, for example, by the control device 15.

The casing 20 is formed in a roughly box-like shape and constitutes an exterior of the fixing member 13. Inside of the casing 20, each component of the fixing device 13 is provided and the fixing device 13 is mounted to an inside of the printer body 2 via the casing 20. The casing 20 includes an entry guide **20*a* along the conveying path 10 at an upstream side in a sheet conveying direction (upward and downward directions) from the fixing nip N. The entry guide 20*a* is configured to guide the sheet, which is conveyed from the second transferring part 12 to the fixing device 13 via the conveying path 10**, to the fixing nip N.

The fixing member 21 is provided at the left side inside the casing 20 and composed of a fixing belt 30, a supporting member 31, a nip forming member 32, a belt guide 33 and a magnetic shielding member 34.

The fixing belt 30 has a roughly cylindrical shape elongated in a sheet width direction (forward and backward directions) being orthogonal to the sheet conveying direction and formed in an endless in a circumferential direction. The fixing belt 30 is rotatably provided around a rotation axis extended in the forward and backward directions. The fixing belt 30 is a sliding belt sliding and rotating in response to rotation of the pressuring member 22 and also serves as a heating belt induction-heated by magnetic flux generated by the heating member 23.

The fixing belt 30 has flexibility and is composed of, for example, a base material layer, an elastic layer provided around the periphery of the base material layer and a release layer covering the elastic layer. In FIG. 2, illustration of these layers is omitted. For example, the base material layer is made of a metallic material, such as nickel, the elastic layer is made of an elastic material, such as silicon rubber, and the release layer is made of a fluorine resin material, such as a PFA tube.

The supporting member 31 is formed in a roughly rectangular cylindrical shape elongated in the forward and backward directions and made of, for example, a metallic material, such as steel use stainless (SUS). The supporting member 31 is arranged in a roughly center inside the fixing belt 30. Both ends of the supporting member 31 are fixed to the casing 20 of the fixing device 13.

The nip forming member 32 is a pressing member formed in a roughly rectangular columnar shape elongated in the forward and backward directions and made of, for example, a material, such as heat-resistant resin. The nip forming member 32 is supported at a side of the pressuring member 22 (the right side) with respect to the supporting member 31 inside the fixing belt 30 and arranged so as to press an inner circumferential face of the fixing belt 30 to the side of the pressuring member 22 (the right side).

The belt guide 33 is formed in a roughly semicircular cylindrical shape elongated in the forward and backward directions and made of, for example, a material, such as magnetic metal, generating heat by magnetic flux generated by the heating member 23. The belt guide 33 is supported at an opposite side to the pressuring member 22 (the left side) with respect to the supporting member 31, and an outer circumferential face of the belt guide 33 comes into contact with the inner circumferential face of the fixing belt 30, thereby assisting and stabilizing rotation movement of the fixing belt 30.

The magnetic shielding member 34 is elongated in the forward and backward directions and formed to have a cross section in an inverted U-shape, and is made of, for example, a material, such as nonmagnetic SUS. The magnetic shielding member 34 is supported at the opposite side to the pressuring member 22 (the left side) with respect to the supporting member 31 inside the belt guide 33.

The pressuring member 22 is a pressuring roller formed in a cylindrical shape elongated in the forward and backward directions and rotatably attached to the casing 20. The pressuring member 22 is arranged in a state of pressuring an outer circumferential face of the fixing member 21 (the fixing belt 30), thereby forming the fixing nip N between the fixing member 21 and the pressuring member 22. For example, at a rear end part of the pressuring member 22, a driving gear (not shown) is fixed and the pressuring member 22 is connected to a driving source (not shown), such as a motor, via the driving gear and driven to rotate by the driving source.

The pressuring member 22 is composed of, for example, a columnar or cylindrical core metal, an elastic layer provided on the periphery of the core metal and a release layer covering the elastic layer. In FIG. 2, illustration of these layers is omitted. For example, the core metal is made of a metallic material, such as aluminum, and the elastic layer is made of an elastic material, such as silicon sponge, and the release layer is made of a fluorine resin material, such as the PFA tube.

The heating member 23 has an exterior cover shape covering the fixing member 21 and is arranged at the opposite side to the pressuring member 22 (the left side) with respect to the fixing member 21. In other words, the heating member 23 is arranged at the opposite side to the pressuring member 22 across the fixing member 21 while being separated from the fixing belt 30 to the outside with a predetermined distance. The heating member 23 is an induction heating (IH) fixing unit including a coil 23*a* to generate magnetic flux by flowing an electric current in the coil 23*a* and to make the magnetic flux act on the fixing belt 30, thereby applying induction heating (IH) to the fixing belt 30. The coil 23*a* is an exterior cover coil wound so as to reciprocate along a rotation axis direction of the fixing belt 30 and formed along a shape of a curved face (an outer circumferential face) of the fixing belt 30. Further, the coil 23*a* is an IH coil generating magnetic flux by flowing an electric current as described above.

The electric charge supplying device 24 is composed of an electric discharge electrode 40 and two grounding electrodes 41. The electric charge supplying device 24 is arranged at an upstream side in the sheet conveying direction from the fixing member 21 and in the vicinity of the fixing member 21. That is, the electric charge supplying device 24 is arranged at an upstream side in a rotating direction of the fixing belt 30 from the fixing nip N. The electric charge supplying device 24 is configured to electrically charge a surface of the fixing belt 30 with positive polarity, for example, by supplying electric charges with positive polarity (plus) to the fixing belt 30 having a triboelectric series with negative polarity (minus). Thus, the toner image (toner) charged with positive polarity (plus) on the sheet passing through the fixing belt 30 is electrically charged with more positive side by the electric charge supplying device 24.

The electric discharge electrode 40 is made of a thin metal plate elongated in a width direction of the fixing belt 30, for example, a SUS plate with a thickness of 0.1 mm and includes a tip end 40*a* formed in a serrated shape in a longitudinal direction of the electric discharge electrode 40. The electric discharge electrode 40 is arranged so that the tip end 40*a* is positioned to face to the surface of the fixing belt 30 and the tip end 40*a* is arranged to be separated from the surface of the fixing belt 30 with a predetermined distance. Preferably, the electric discharge electrode 40 is arranged so that the tip end 40*a* is oriented to a rotation center of the fixing belt 30. The electric discharge electrode 40 is configured so that a base end 40*b* is connected to the voltage applying part 26 and an applied voltage (an electric potential difference between each grounding electrode 41 and the electric discharge electrode 40) from the voltage applying part 26 causes electric discharge (e.g., corona discharge) at the tip end 40*a*. incidentally, an electric current (an output current value) flowed by the electric discharge of the electric discharge electrode 40 is determined on the basis of the applied voltage (a voltage value) or a supplied current (a current value) from the voltage applying part 26. For example, the value of the supplied current from the voltage applying part 26 is a small value in comparison with the output current value of the electric discharge electrode 40. As the value of the supplied current from the voltage applying part 26 increases, so the output current value of the electric discharge electrode 40 increases.

Each grounding electrode 41 is made of a material, such as insulating resin, and formed in a plate shape elongated in the width direction of the fixing belt 30. The two grounding electrodes 41 are arranged parallel to each other at both sides of the electric discharge electrode 40 in the rotating direction of the fixing belt 30 so as to enclose the electric discharge electrode 40. An end part of each grounding electrode 41 at a side of the tip end 40*a* of the electric discharge electrode 40 is arranged to be separated from the surface of the fixing belt 30 with a predetermined distance. Each grounding electrode 41 is grounded via a Zener diode 42. For example, each grounding electrode 41 functions so that an electric field contributed to the electric discharge generated at the tip end 40*a* of the electric discharge electrode 40 is uniformly formed over the width direction of the fixing belt 30 without concentrating on only a tip of a needle.

The toner charge detecting part 25 is arranged in the vicinity of the conveying path 10 at an upstream side in the sheet conveying direction from the fixing nip N. The toner charge detecting part 25 detects the charged amount of the toner composing the toner image before the sheet having the formed toner image enters the fixing member 21. For example, the toner charge detecting part 25 may measure an electric potential of the toner on a surface of the sheet with a surface electrometer and detect the charged amount of the toner (toner charged amount) on the basis of its measurement result. The toner charge detecting part 25 is connected to the voltage applying part 26 and notifies the voltage applying part 26 of a detection result of the toner charged amount.

The voltage applying part 26 is connected to a power supply (not shown), such as a constant current power supply, and supplies the applied voltage to the electric discharge electrode 40 of the electric charge supplying device 24 by using power supplied from the power supply. At this time, the voltage applying part 26 applies a voltage with the same polarity as that of the toner to the electric discharge electrode 40 so that the electric discharge electrode 40 electrically discharges the electric charges having the same polarity as that of the toner composing the toner image fixed by the fixing device (e.g., the toner used in each image forming part 7). In other words, the electric charge supplying device 24 supplies the electric charges with the same polarity as that of the toner composing the toner image to a surface of the fixing member 21 with the electric discharge generated by the electric discharge electrode 40. For example, when the toner on the sheet is electrically charged with positive polarity, the electric charge supplying device 24 electrically charges the fixing member 21 with the positive electric charges.

Further, the voltage applying part 26 adjusts the output current value of an electric current flowed by the electric discharge of the electric discharge electrode 40 on the basis of the detection result of the toner charged amount by the toner charge detecting part 25 and, for example, backwardly calculates and sets the voltage value of the applied voltage of the electric discharge electrode 40 so as to obtain a predetermined output current value. For example, when the toner charged amount is equal to or more than a predetermined charged amount threshold value, the voltage applying part 26 sets the output current value to a normal current value (e.g., 5 μA). When the toner charged amount is lower than the predetermined charged amount threshold value, the voltage applying part 26 sets the output current value to a current value (e.g., 6 to 8 μA) higher than the normal current value. Alternatively, the voltage applying part 26 may set charged amount threshold values at plural stages and output current values corresponding to these charged amount threshold values in advance, or may set a mathematical expression for calculating the output current value on the basis of the toner charged amount in advance.

According to the present embodiment, as described above, the fixing device 13 of the color printer 1 includes the fixing member 21, the pressuring member 22 and the electric charge supplying device 24. The fixing member 21 is rotatably provided, comes into contact with a recording medium, such as the sheet, on which the toner image is formed, and heats the recording medium. The pressuring member 22 is rotatably provided, and pressures the recording medium passing between the fixing member 21 and the pressuring member 22. The electric charge supplying device 24 electrically discharges electric charges with same polarity as polarity of the toner composing the toner image and supplies the electric charges to the surface of the fixing member 21. The output current value of the electric current flowed by the electric discharge of the electric charge supplying device 24 is adjusted on the basis of the toner charged amount of the toner image so as to provide a sufficient amount of electric charge of the fixing member 21 for the fixing process. When the toner charged amount is equal to or more than the predetermined charged amount threshold value, the output current value is set to the normal current value. When the toner charged amount is less than the predetermined charged amount threshold value, the output current value is set to the current value higher than the normal current value.

Thereby, in the fixing device 13, when the fixing member 21 fixes the toner image to the sheet, the electric charges with the same polarity as that of the toner are electrically charged with an appropriate amount of electric charge corresponding to the toner charged amount of the toner image. Thus, adhesion of the toner to the fixing member 21, which is contributed to insufficiency of a charged amount, can be restrained, and adhesion of a toner resin component to the electric charge supplying device 24, which is contributed to an excessive charged amount, can be restrained. Only when the toner charged amount of the toner image is reduced, the amount of electric charge to the fixing member 21 can be optimally adjusted by increasing the output (applied voltage) of the electric charge supplying device 24. Consequently, by minimum required configuration, it is possible to restrain deterioration of the electric charge supplying device 24 while restraining electrostatic offset phenomenon of the fixing member 21.

According to the present embodiment, the fixing device 13 further includes the toner charge detecting part 25 detecting the toner charged amount before the recording medium enters the fixing member 21. Thereby, it is possible to steadily grasp the toner charged amount of the toner image as a fixed object and to appropriately supply of the electric charges to the fixing member 21 without delay.

According to the present embodiment, the electric charge supplying device 24 includes the electric discharge electrode 40 formed of a thin plate elongated in the rotation axis direction of the fixing member 21. The tip end 40*a* of the electric discharge electrode 40 is formed in a serrated shape in the longitudinal direction of the electric charge supplying device 24, and the electric discharge electrode 40 is arranged so that the tip end 40*a* faces to the fixing member 21. Thereby, the serrated-shaped electric discharge electrode 40 can electrically discharge in an appropriate position with high accuracy in comparison with a wire-shaped electrode and can supply the sufficient electric charges to the fixing belt 30 of the fixing member 21 even at a low current value.

According to the present embodiment, the electric charge supplying device 24 includes the two grounding electrodes 41 at both sides of the electric discharge electrode 40 in the rotating direction of the fixing member 21. Thus, the two grounding electrodes 41 are arranged so as to step over the electric discharge electrode 40, thereby stabilizing the corona discharge of the electric discharge electrode 40.

According to the present embodiment, the grounding electrodes 41 are grounded via the Zener diode 42. Thus, it is possible to stabilize the electric potential difference between the electric discharge electrode 40 and each grounding electrode 41 and to improve performance of electric discharge with respect to the fixing belt 30 of the fixing member 21.

Although the above-described embodiment is described about configuration in which the fixing device 13 includes the toner charge detecting part 25 and the voltage applying part 26 adjusts the output current value flowed by the electric discharge of the electric charge supplying device 24 on the basis of the toner charged amount of the toner image, adjustment of the output current value by the voltage applying part 26 is not restricted by this.

For example, in another embodiment, the voltage applying part 26 adjusts the output current value flowed by the electric discharge of the electric charge supplying device 24 in compliance with progress condition after previous use of the fixing member 21 before present use of the fixing member 21 so as to provide a sufficient amount of electric charge of the fixing member 21 for the fixing process. In the following description of another embodiment, the description of the same configuration as that of the above-described embodiment is omitted.

First, a first example of another embodiment will be described. In the first example, the control device 15 counts an elapsed time from a time when the previous fixing process is completed (after the previous use of the fixing member 21) to a time when the present fixing process is started (before the present use of the fixing member 21) and outputs the elapsed time as a counting result to the voltage applying part 26.

In the first example, in the voltage applying part 26, the above-described progress condition is defined as whether or not the elapsed time between the fixing processes is equal to or more than a predetermined time threshold value (e.g., eight hours). When the elapsed time is less than the predetermined time threshold value, the voltage applying part 26 sets the output current value to the normal current value. When the elapsed time is equal to or more than the predetermined time threshold value, the voltage applying part 26 sets the output current value to the current value higher than the normal current value.

When a certain period of time has passed after the previous use of the fixing member 21 before the present use of the fixing member 21 (for example, in a case of intermittent printing), there is possibility that the electric charges supplied to the fixing member 21 by the electric charge supplying device 24 at the previous use is reduced by spontaneous discharge. However, according to the first example, since the voltage applying part 26 at a time of the present use sets the output current value to the current value higher than the normal current value and the electric charge supplying device 24 electrically discharges in response to this high current value, sufficient electric charges required for the fixing process are supplied to the fixing member 21. Incidentally, when much time has not passed after the previous use of the fixing member 21 before the present use of the fixing member 21 (for example, in a case of consecutive printing), the electric charges of the fixing member 21 are hardly reduced. Thus, the voltage applying part 26 sets the output current value to the normal current value and the electric charge supplying device 24 electrically discharges in response to the normal current value, sufficient electric charges required for the fixing process are supplied to the fixing member 21. Consequently, according to the first example, sufficient electric charges required for the fixing process can be supplied to the fixing member 21 irrespective of the elapsed time between the fixing processes of the fixing member 21.

Figure 3:
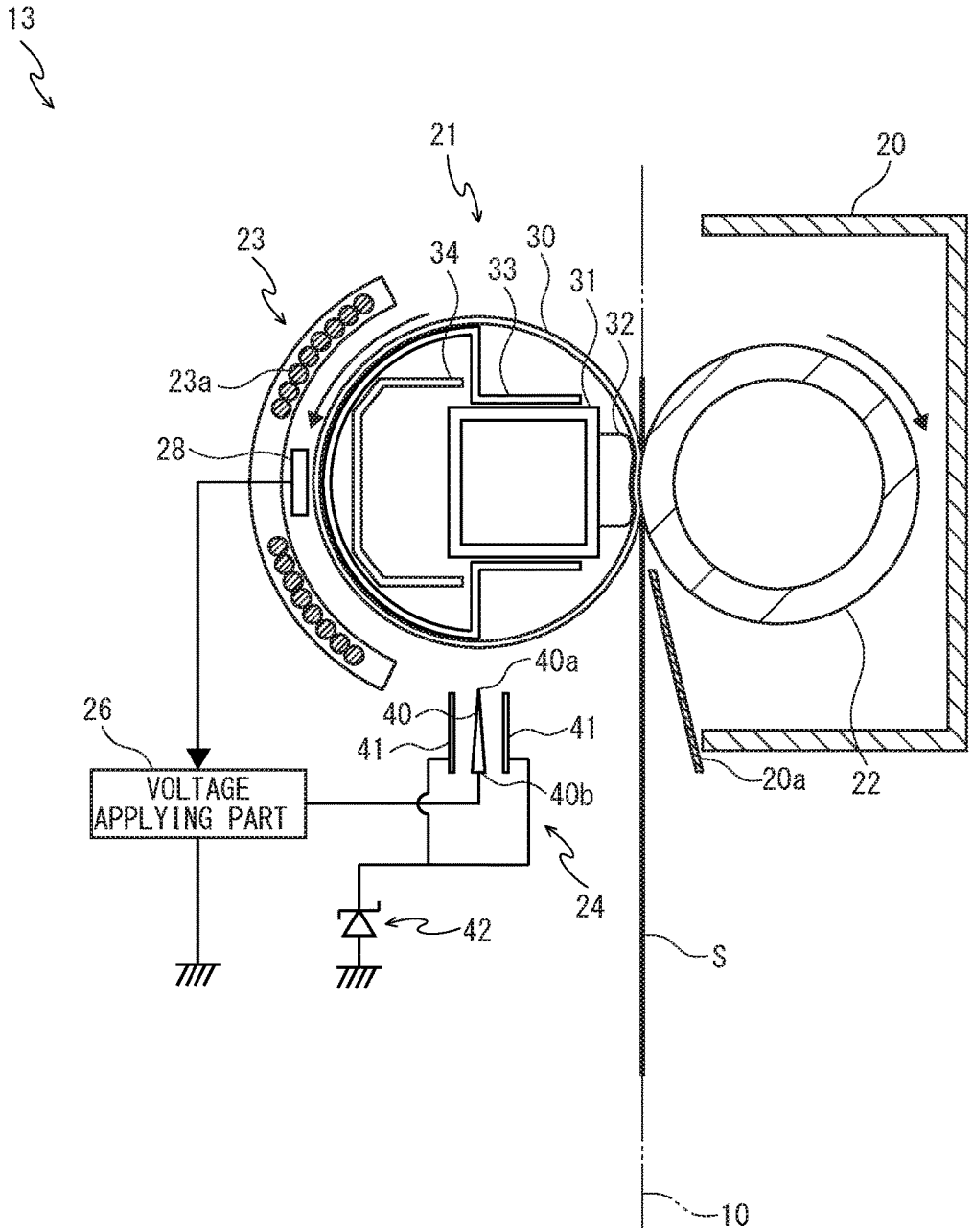
FIG. 3 is a sectional view showing a fixing device according to another embodiment of the present disclosure.

Next, a second example of another embodiment will be described. In the second example, as shown in FIG. 3, the fixing device 13 includes a temperature detector 28. The temperature detector 28 detects surface temperature (fixing temperature) of the fixing belt 30 and is composed of, for example, a thermistor arranged in a noncontact manner with respect to the fixing belt 30. The temperature detector 28 is arranged, for example, at an upstream side in the rotating direction of the fixing belt 30 from the fixing nip N. The temperature detector 28 is connected to the voltage applying part 26 and notifies the voltage applying part 26 of a detection result of the fixing temperature. The temperature detector 28 detects, for example, the fixing temperature at the start of the present fixing process (before the present use of the fixing member 21).

In the second example, in the voltage applying part 26, the above-described progress condition is defined as whether or not the fixing temperature before the present use of the fixing member 21 is equal to or more than a predetermined temperature threshold value (e.g., 40 degrees Celsius). When the fixing temperature exceeds the predetermined temperature threshold value, the voltage applying part 26 sets the output current value to the normal current value. When the fixing temperature is equal to or less than the predetermined temperature threshold value, the voltage applying part 26 sets the output current value to the current value higher than the normal current value.

When the fixing temperature before the present use of the fixing member 21 is reduced (equal to or less than the predetermined temperature threshold value), there is a possibility that a certain period of time has passed before the present use. Thus, in the second example, when the fixing temperature before the present use is reduced, similarly to the first example, the voltage applying part sets the output current value to the current value higher than the normal current value and the electric charge supplying device 24 electrically discharges in response to this high current value. Incidentally, when the fixing temperature before the present use of the fixing member 21 is not reduced, much time has not passed before the present use. Thus, in the second example, when the fixing temperature before the present use is not reduced, similarly to the first example, the voltage applying part 26 sets the output current value to the normal current value and the electric charge supplying device 24 electrically discharges in response to the normal current value. Thereby, according to the second example, sufficient electric charges required for the fixing process can be supplied to the fixing member 21 irrespective of the fixing temperature before the present use of the fixing member 21.

Therefore, in another embodiment described above, the deterioration of the electric charge supplying device 24 can be restrained while electrostatic offset phenomenon of the fixing member 21 is restrained.

The above-described embodiments have described configuration in which the electric charge supplying device 24 includes the two grounding electrodes 41, but the configuration of the electric charge supplying device 24 is not restricted by this. For example, in a different embodiment, the electric charge supplying device 24 may be configured to include one grounding electrode 41 at one side of the upstream side in the rotating direction of the fixing member 21 from the electric discharge electrode 40. This can reduce the number of components of the electric charge supplying device 24, miniaturize the electric charge supplying device 24, and then, reduce cost of the electric charge supplying device 24 and improve space efficiency.

The above-described embodiments have described configuration in which the heating member 23 of the IH fixing unit is provided as the heating source heating the fixing member 21, but the heating source is not restricted by this configuration. For example, in another different embodiment, a halogen heater or a ceramic heater may be provided as the heating source.

Although the above-described embodiments have described about a case applying the configuration of the present disclosure to the color printer 1, in a further different embodiment, the configuration of the present disclosure may be applied to another image forming apparatus, such as a monochrome printer, a copying machine, a facsimile and a multifunction peripheral.

Further, the above-description of the embodiments was described about one example of the fixing device and the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. A fixing device comprising:

a fixing member being rotatably provided, coming into contact with a recording medium on which a toner image is formed, and heating the recording medium;

a pressuring member being rotatably provided, and pressuring the recording medium passing between the fixing member and the pressuring member; and an electric charge supplying device electrically discharging electric charges with same polarity as polarity of toner composing the toner image and supplying the electric charges to a surface of the fixing member, wherein an output current value of an electric current flowed by the electric discharge of the electric charge supplying device is adjusted on the basis of a toner charged amount of the toner image, when the toner charged amount is equal to or more than a predetermined charged amount threshold value, the output current value is set to a normal current value, when the toner charged amount is less than the predetermined charged amount threshold value, the output current value is set to a current value higher than the normal current value, the electric charge supplying device includes an electric discharge electrode formed of a thin plate elongated in a rotation axis direction of the fixing member, a tip end of the electric discharge electrode is formed in a serrated shape in a longitudinal direction of the electric discharge electrode, the electric discharge electrode is arranged so that the tip end faces to the fixing member.

2. The fixing device according to claim 1 further comprising:

a toner charge detecting part detecting the toner charged amount before the recording medium enters the fixing member.

3. A fixing device comprising:

a fixing member being rotatably provided, coming into contact with a recording medium on which a toner image is formed, and heating the recording medium;

a pressuring member being rotatably provided, and pressuring the recording medium passing between the fixing member and the pressuring member; and an electric charge supplying device electrically discharging electric charges with same polarity as polarity of toner composing the toner image and supplying the electric charges to a surface of the fixing member, wherein an output current value of an electric current flowed by the electric discharge of the electric charge supplying device is adjusted in compliance with progress condition before present use of the fixing member, the progress condition is defined as whether or not an elapsed time from previous use of the fixing member to the present use of the fixing member is equal to or more than a predetermined time threshold value, when the elapsed time is less than the predetermined time threshold value, the output current value is set to a normal current value, when the elapsed time is equal to or more than the predetermined time threshold value, the output current value is set to a current value higher than the normal current value.

4. A fixing device comprising:

a fixing member being rotatably provided, coming into contact with a recording medium on which a toner image is formed, and heating the recording medium;

a pressuring member being rotatably provided, and pressuring the recording medium passing between the fixing member and the pressuring member; and an electric charge supplying device electrically discharging electric charges with same polarity as polarity of toner composing the toner image and supplying the electric charges to a surface of the fixing member, wherein an output current value of an electric current flowed by the electric discharge of the electric charge supplying device is adjusted in compliance with progress condition before present use of the fixing member, the progress condition is defined as whether or not fixing temperature before the present use of the fixing member is equal to or more than a predetermined temperature threshold value, when the fixing temperature exceeds the predetermined temperature threshold value, the output current value is set to a normal current value, when the fixing temperature is equal to or less than the predetermined temperature threshold value, the output current value is set to a current value higher than the normal current value.

5. The fixing device according to claim 1, wherein the electric charge supplying device includes grounding electrodes at both sides of the electric discharge electrode in a rotating direction of the fixing member.

6. The fixing device according to claim 1, wherein the electric charge supplying device includes a grounding electrode at one side of an upstream side in a rotating direction of the fixing member from the electric discharge electrode.

7. The fixing device according to claim 5, wherein the grounding electrodes are grounded via a Zener diode.

8. The fixing device according to claim 1, wherein the electric charge supplying device is arranged at an upstream side in a sheet conveying direction from the fixing member and at an upstream side in a rotating direction of the fixing member from a fixing nip between the fixing member and the pressuring member.

9. The fixing device according to claim 4 further comprising:

a temperature detector being arranged at an upstream side in a rotating direction of the fixing member from a fixing nip between the fixing member and the pressuring member and detecting the fixing temperature.

10. An image forming apparatus comprising:
the fixing device according to claim 1.

11. An image forming apparatus comprising:
the fixing device according to claim 2.

12. An image forming apparatus comprising:
the fixing device according to claim 3.

13. An image forming apparatus comprising:
the fixing device according to claim 4.

14. An image forming apparatus comprising:
the fixing device according to claim 5.

15. An image forming apparatus comprising:
the fixing device according to claim 6.

16. An image forming apparatus comprising:
the fixing device according to claim 7.

17. An image forming apparatus comprising:
the fixing device according to claim 8.

18. An image forming apparatus comprising:
the fixing device according to claim 9.

* * * * *